United States Patent [19]

Szabo

[11] 4,323,236

[45] Apr. 6, 1982

[54] BODY EXERCISING WEIGHT APPARATUS

[76] Inventor: William Szabo, 8138 Foothill Blvd., Sunland, Calif. 91040

[21] Appl. No.: 79,095

[22] Filed: Sep. 26, 1979

[51] Int. Cl.[3] ..... A63B 21/06

[52] U.S. Cl. ..... 272/117; 272/DIG. 4

[58] Field of Search ..... 272/117, 116, 130, 134, 272/143, 118, 132, 123

[56] References Cited

U.S. PATENT DOCUMENTS

| | | | |
|---|---|---|---|
| 3,003,765 | 10/1961 | Dove | 272/117 |
| 3,010,720 | 11/1961 | Allard | 272/117 |
| 3,516,661 | 6/1970 | Hansen | 272/132 |
| 3,918,710 | 11/1975 | Nieojewski | 272/117 |

FOREIGN PATENT DOCUMENTS

| | | | |
|---|---|---|---|
| 1016724 | 9/1952 | France | 272/117 |

OTHER PUBLICATIONS

Calf Machine-*Physical Fitness Equipment* Catalogue No. 69, p. 22, Oct. 7, 1969, Marcy Gym Equipment Co.

*Primary Examiner*—Richard C. Pinkham
*Assistant Examiner*—William R. Browne
*Attorney, Agent, or Firm*—Robert J. Schaap

[57] ABSTRACT

A body exercising apparatus, in the form of a weight lifting apparatus, which includes an elongate lever arm having first and second opposite ends. The first end of the lever arm is capable of being pivotally mounted to a supporting structure, and preferably a relatively vertically disposed wall. For this purpose, a mounting element is provided on the first end of the lever arm for pivotally mounting this lever arm to such relatively permanent structure and preferably such vertically disposed wall. A weight retaining rod, is operatively mounted on the lever arm and is capable of receiving conventional bar-bell type weights in selected amounts. A leg member is secured to the lever arm and extends downwardly therefrom so as to be engageable with a floor or similar horizontal surface to thereby control the lower most limit of movement of the lever arm. A handle member is located at the second end of the lever arm for engagement by the hands of a user of the apparatus so this user can attempt to lift the lever arm about the pivotal connection with respect to the supporting structure against one or more weights placed on the weight retaining rod. In a more preferred aspect, the handle member is adjustably positionable with respect to the lever arm so as to accommodate the overall height of the user.

14 Claims, 4 Drawing Figures

BODY EXERCISING WEIGHT APPARATUS

BACKGROUND OF THE INVENTION

1. Field of the Invention

This invention relates in general to certain new and useful improvements in body exercising apparatus, and more particularly, to body exercising apparatus uniquely adaptable for relatively inexpensive employment and in which a user attempts to lift one or more weights selectively located on a lever arm of the apparatus by lifting one end of the lever arm and where the other end thereof is pivotally mounted.

2. Brief Description of the Prior Art

In recent years, there has been an increased awareness and interest in body exercising for purposes of health improvement and control. As a result thereof, there has been a large number of body exercising apparatus which have been introduced into the marketplace. One of the most common types of body exercising apparatus is that in which the user attempts to exert an upwardly directed force, e.g., a lifting force against a weight, as for example, one or more weights placed on a cable. For example, the user of such exercising apparatus is required to exert an amount of force sufficient to overcome a vertical downward force vector imposed by a selected amount of weight placed on or introduced with respect to such apparatus. This weight exercising apparatus may adopt many forms in which the user may assume various positions of use as for example, a prone position, a generally upright position, or the like.

Heretofore, there has not been any commercially available body exercising apparatus which is generally available in a construction which is not mechanically complex and hence a construction which is available at a relatively low unit cost. Typically, each of the commercially available body exercising apparatus which involve the lifting of one or more selectively imposed weights are designed for commercial use as for example, in public gymnasiums and so-called "health" establishments.

While the user of "bar-bells" and the so-called "individually hand held dumb-bells" which utilize an elongate bar and one or more generally circular weights mountable thereon have been well known, they are expensive and limited in their effectiveness. There is no commercially available exercising apparatus which may be used, other than by a commercial establishment, and in a relatively low unit cost, by the average individual and which involves a selective placement of weights normally used on such conventional bar-bells and dumb-bells.

OBJECTS OF THE INVENTION

It is, therefore, a primary object of the present invention to provide a body exercising apparatus which simulates that of an exercising apparatus normally found in commercial body exercising institutes but which is provided in a construction and operated in a manner so that is is available at a relatively low cost and is capable of being afforded and used by private individuals, such as home users.

It is another object of the present invention to provide a body exercising apparatus of the type stated which includes a single lever arm capable of being mounted to a relatively permanent generally vertically disposed wall and which is designed to carry the selectively imposed weights by a user thereof.

It is a further object of the present invention to provide a body exercising apparatus of the type stated which affords all of the flexibility of a body exercising apparatus normally found at commercial body exercising institutes but which is relatively available at a low cost and which is highly reliable in its operation.

It is an additional object of the present invention to provide a body exercising apparatus of the type stated which includes a lever arm which can be permanently mounted to a permanently existing generally vertical wall and which also includes a leg member for limiting the downward movement of the pivotably mounted lever arm and where such arm is designed to carry weights against which an exercisable action is to be exerted.

It is also an object of the present invention to provide a body exercising apparatus of the type stated which includes an adjustably positionable handle mechanism for engagement by a user thereof.

With the above and other objects in view, my invention resides in the novel features of form, construction, arrangement and combination of parts presently described and pointed out in the claims.

BRIEF SUMMARY OF THE DISCLOSURE

A body exercising apparatus comprised of a lever arm which is generally elongate and having first and second opposite ends. A mounting means is provided on the first end of the lever arm for pivotally mounting the lever arm to a generally stationary structure. In one preferred embodiment of the present invention, the lever arm is pivotally mounted to a relatively permanent generally vertically positioned wall.

In an alternative embodiment of the present invention, the lever arm may be physically and pivotally mounted to a structure which is mounted on or otherwise resting upon a floor or similar horizontal surface, as opposed to a generally vertically disposed wall. In this embodiment of the invention, as well as the embodiment of the invention which utilizes a wall mountable exercising apparatus, the invention comprises an adjustable positioning means which is located at the second end of the lever arm, that is the end distal from the pivotal end. Further, a handle is secured to the adjustable positioning means so that the height of the handle is adjustably positionable relative to the lever arm.

The adjustable positioning means in the preferred form of the invention adopts the shape of a tubular member, and particularly a rectangularly shaped tubular member which is secured to the second end of the lever arm. Further, a pole is located within this tubular member and the handle means is secured to the pole. In this way, the tubular member and the pole may have a plurality of vertically spaced apart holes which are alignable in certain positions so that a pin element may be inserted into the aligned holes in the pole and tubular member. In this way, the pole may be locked to the tubular member in any of a plurality of selected positions with respect to the tubular member.

In another preferred aspect of the present invention, the mounting means for pivotally mounting the lever arm to the wall may comprise a bracket having at least one flat plate which engages the flat wall. This bracket means also includes at least one outwardly struck element and preferably a plurality of outwardly struck elements such as a clevised member for pivotally retaining the first end of the lever arm. In another preferred aspect of the invention, the overall length of the lever arm may be adjustable. Thus, the lever arm may be comprised of a first lever arm section which is telescopically located within a second lever arm section. In this way, the lever arm sections may be extended or retracted relative to one another to thereby adjust the overall length of the lever arm.

The term generally vertically disposed wall means a wall or other generally vertically disposed surface to which the lever arm may have one end pivotally mounted. Further the wall or other surface need not be truly vertical but it could be inclined somewhat with respect to a true vertical.

One of the advantages of the apparatus of the present invention, is that it is capable of being constructed at a relatively low cost. For example, one embodiment of the apparatus is designed for wall mounting so as to avoid the necessity of a relatively expensive framework to pivotally retain the lever arm. In addition, the apparatus, is constructed so that it can be made from a relatively few number of pieces, thereby also leading to easy assembly.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principles of the invention, but it is to be understood that such detailed descriptions are not to be taken in a limiting sense.

BRIEF DESCRIPTION OF THE DRAWINGS

Figure 1:
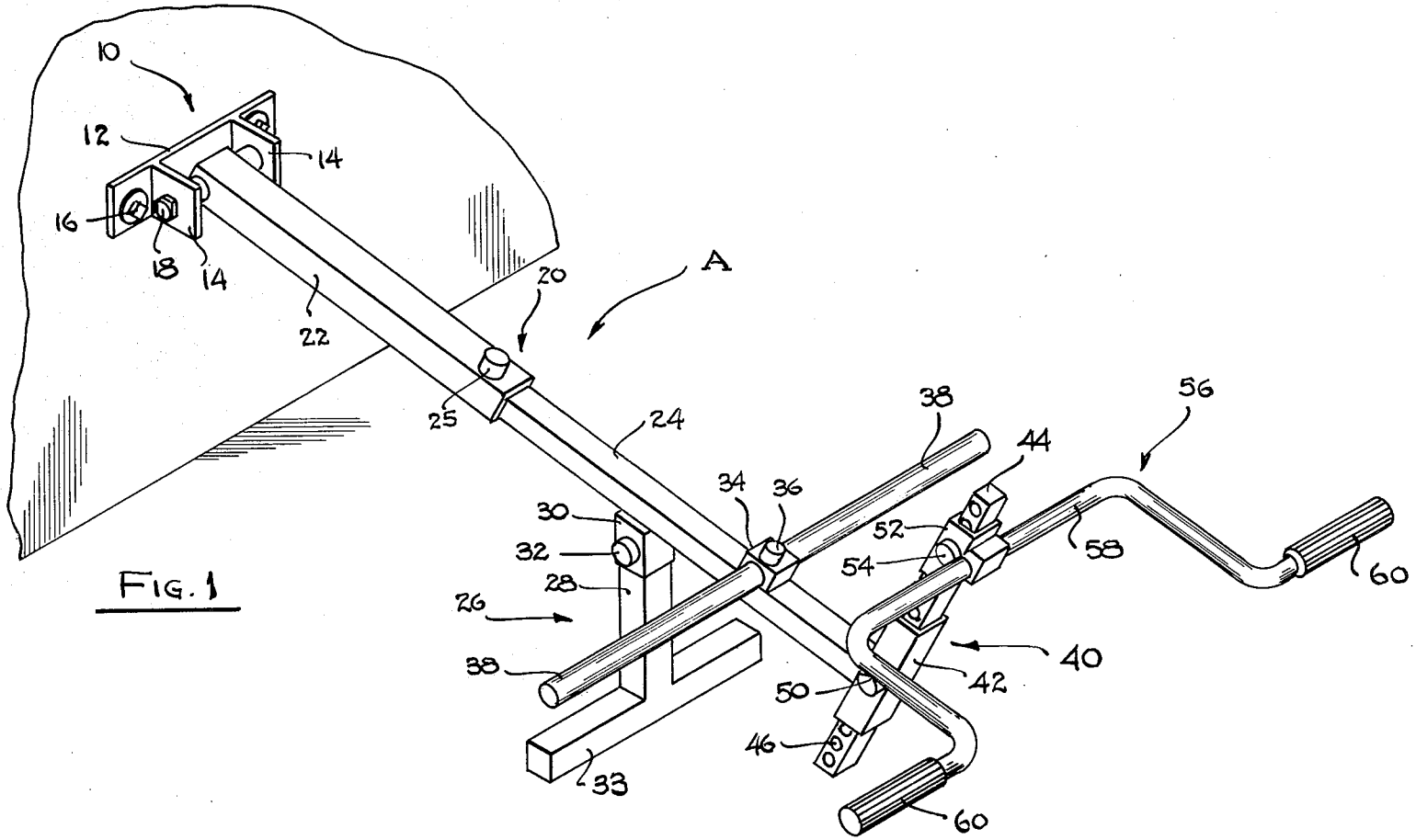
Figure 2:
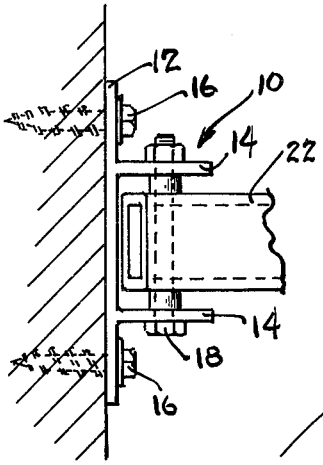
Figure 3:
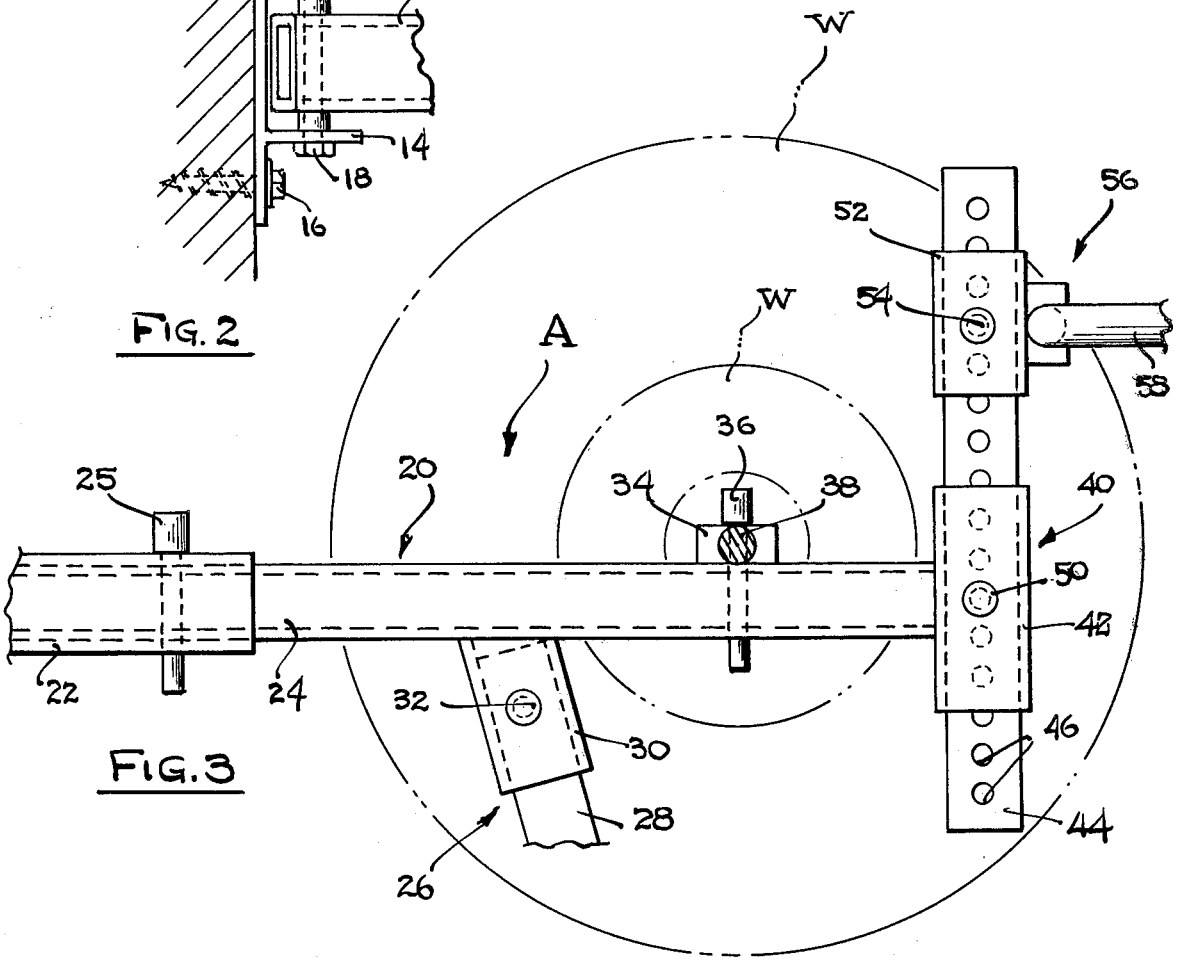
Figure 4:
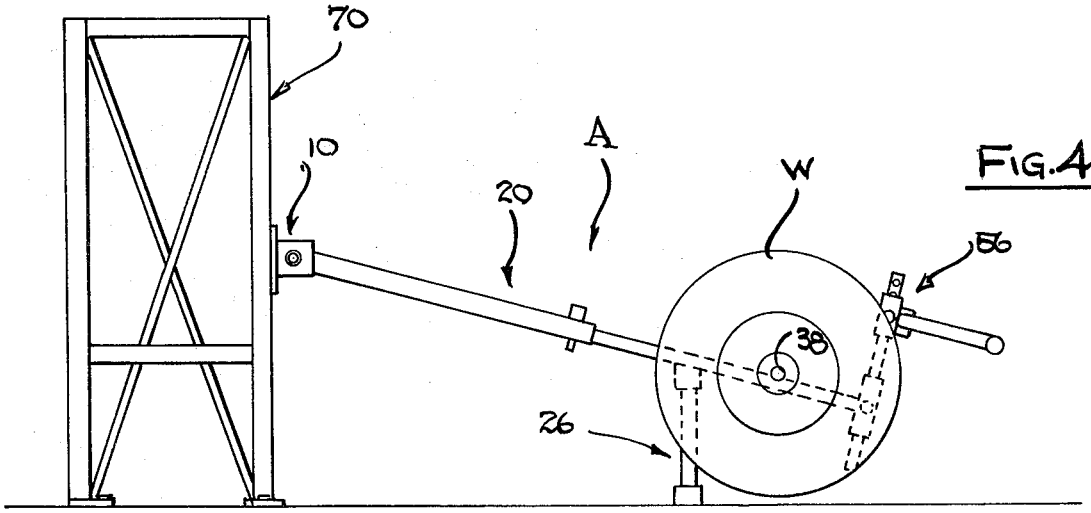

Having thus described the invention in general terms, reference will now be made to the accompanying drawings in which:

FIG. 1 is a perspective view of a weightlifting body exercising apparatus constructed in accordance with and embodying the present invention;

FIG. 2 is a horizontal fragmentary sectional view showing a portion of the mounting means for mounting the apparatus of the present invention to a vertially disposed wall;

FIG. 3 is a vertical sectional view of a portion of the apparatus of FIG. 1 and showing the depending leg mechanism for limiting the lowermost movement of the lever arm and also a means for adjustably positioning a handle mechanism on the lever arm; and FIG. 4 is a fragmentary side elevational view showing an alternate embodiment of the invention in which the lever arm forming part of the exercising apparatus of the present invention is mounted to another structure, as opposed to a vertically disposed wall.

DETAILED DESCRIPTION OF PREFERRED EMBODIMENTS

Referring now in more detail and by reference characters to the drawings which illustrate certain practical embodiments of the present invention, A designates a body exercising apparatus which relies upon a construction utilizing conventional bar-bell weights.

The apparatus A is more fully illustrated in FIGS. 1–4 of the drawings. In one of the embodiments of the exercising apparatus A which adopts the configuration of a wall-mounted unit, the apparatus comprises a mounting means, in the form of a bracket 10, which is comprised of a relatively flat plate 12 having at least one and preferably a pair of outwardly struck flanges 14 so as to form a clevised member. Moreover, this mounting means such as the bracket 10 is secured to the wall or other vertically disposed surface by means of one or more bolts or similar mechanical fastening members 16, in the manner as illustrated. Finally, this mounting means is also comprised of a bolt or similar pivot mechanism such as a bolt 18 which receives a first end of a lever arm 20, in the manner as illustrated in FIG. 1 of the drawings.

In one aspect of the present invention, the lever arm 20 is described and illustrated as being mounted on a generally vertically positioned wall. In this case, it should be understood that the bracket 10 should be mounted on at least a structural member which is vertically positioned. Moreover, this wall or other structural member need not be perfectly vertically positioned such that it can be disposed from a true vertical position by a reasonable angle, e.g., 15–30 degrees or so. Nevertheless, it is fairly important with respect to the present invention, in order to maintain simplicity of operation and construction that the pivot arm is pivotally connected to a wall which is considered to be a generally vertically disposed wall which is no greater than about 30 degrees from the true perpendicular to a normal horizontal plane.

Also important in connection with the present invention is the fact that the lever arm 20 is the only component, other than the mounting means, which is physically connected to any stationary structure, as for example, a generally vertically disposed wall. Thus, unlike other prior art apparatus, only the lever arm with the mounting means on the end thereof is physically connected and moreover, is physically pivotally connected to a generally vertically disposed wall or other vertically disposed member. Thus, and also in this concept of the invention, the term "wall" could also adopt a side face of a vertically disposed beam, or the like, as aforesaid.

Also in accordance with the present invention, the generally vertically disposed wall is often referred to as a relatively permanently disposed vertical wall. In this same concept, the term relatively permanent is used in the sense that the wall to which the lever arm is affixed is not periodically moved. Moreover, the term "relatively permanent" with respect to the wall, is used in the sense that this wall typically remains for a substantial period of time, that is a wall which does not serve as a mere partition and which is removed and replaced by another partition on a periodic basis. Further, it should be understood that the term relatively permanent vertically disposed wall is used in the sense that it includes a wall having at least some means for physically retaining a mounting means.

The lever arm of the present invention is adjustably positionable in the sense that its overall length can be adjusted to accomodate a particular environment or a particular application. Consequently, in a preferred embodiment of invention, the lever arm 20 is comprised of a first lever arm section 22, such as an outer tubular lever arm section. The lever arm 20 is also provided with a second lever arm section 24 such as a telescopically disposed lever arm section which is capable of being telescopically disposed within the first lever arm section 22. Thus, by reference to at least FIGS. 1 and 3, it can be observed that the second lever arm section 24 can be telescopically extended or retracted within the first lever arm section 22. Moreover, the second lever arm section may be affixed in a desired position with respect to the first lever arm section 22 in order to achieve a desired length of the overall lever arm 20 and this position may be retained and secured by means of a removable locking pin 25, also as illustrated in FIG. 1 of the drawings. Thus, and for this purpose, the tube 22 as well as the lever arm section 24 would each be provided with a plurality of alignable apertures (not shown). In this way, any reasonable overall telescopic length of the lever arm 20 could be achieved.

Also mounted on the lever arm 20, and particularly the lever arm section 24 is a leg mechanism 26. Here again, the leg mechanism 26 is comprised of a generally vertically disposed or downwardly extending leg 28 which is capable of fitting within the somewhat tubular and preferably rectangularly shaped collar 30 formed on the underside of the second lever arm section 24. Moreover, the leg 28 is retained within the collar 30 in a selected position by means of a bolt or similar removable fastening member 32. It should be understood that the leg 28 could be provided with a plurality of apertures in order to receive the bolt 32. In this way, the leg 28 could be adjustably positioned within the collar 30. Moreover, the leg 28 is provided with a transversely extending cross bar 33 which is adapted to engage the floor or other supporting surface. In this case, it should be understood that the term "floor" represents any generally horizontally disposed surface upon which the leg member 26 may be disposed and supported against lowermost movement of the lever arm 20.

Also welded or otherwise secured to the lever arm 20 and particularly the lever arm section 24 thereof is a transversely extending block 34. Moreover, retained by the block 34, through the action of a pin 36, is a transversely extending somewhat circularly shaped rod 38 which forms part of a weight retaining means on the lever arm in order to removably retain bar-bell type weights. In accordance with this embodiment of the invention, bar-bell type weights W which are typically circularly shaped steel plates having a central aperture therein can be disposed at opposite ends of the rod 38. A plurality of different sized bar-bell type weights are schematically illustrated in phantom lines in FIG. 3. In this way, a plurality of such bar-bell weights can be located on the bar 38 in order to provide the effective weight for the user to lift against. Moreover, it should be understood that snap-locking mechanisms or other forms of locks could be used in order to secure the bar-bell type weights on the bar 38.

Located at the second or outer end of the lever arm 20 is an adjustable positioning mechanism 40. In this embodiment of the invention, the adjustable positioning mechanism 40 comprises a tubular sleeve, and preferably rectangularly shaped tubular sleeve 42, which is welded or otherwise secured to the second transverse end of the lever arm 20 and particularly the lever arm section 24. Vertically shiftably disposed within the tube 42 is a pole 44, the latter of which also has essentially the same size and overall shape as the sleeve 42 but nevertheless which is sized to be shiftably disposed therein. In addition, the tube 42 as well as the pole 44 are provided with a plurality of vertically spaced apart and generally alignable apertures such as apertures 46 as illustrated in FIG. 1 of the drawings. In this way, any one of the apertures 46 may be alignable with an aperture in the tube 42 in order to receive a locking pin 50. Thus, the pole 44 is vertically adjustably positionable with respect to the sleeve 42 and retained in certain positions with respect to the sleeve 42 by means of the locking pin 50.

Shiftably mounted on the vertically shiftable pole 44 of the adjustable positioning mechanism 40 is a sleeve 52 which may be releasably secured to the vertically positionable pole 44 by means of a pin 54. Here again the pin 54 fits in apertures in the sleeve 52 and any one of the set of apertures 46 in the pole 44. In this way, a second means of adjustment is provided for a handle as hereinafter described.

A handle member 56 is secured to the bracket 52 and is thereby capable of being shifted vertically with respect to the lever arm 20. In this case, the handle member 56 includes a U-shape section 58 which extends outwardly with respect to the lever arm 20.

At its outer end, the handle member 56 is provided with a pair of outwardly diverging handle gripping elements 60. In the manner as illustrated, these handle gripping elements 60 may be provided with hard rubber-type hand grips or similar hand grips as may be required.

In accordance with the above outlined construction, the exercising apparatus of the present invention can be mounted to essentially any existing wall which preferably contains at least some vertically disposed structural member for receiving at least the bracket 10. Thereafter, the exercising apparatus A of the present invention can be shiftable on this bracket 10 so that the user thereof can introduce the required amount of weight on the weight retaining means as for example, the cross bar 38. The user will thereupon engage the handle means 56 and attempt to lift the same against the vertical downward vector force imposed by the weights on the cross bar 38. The lower most limit of movement is controlled by the leg member 26.

This adjustable positioning mechanism is effective in that it enables the handle to be positioned at a desired height to accommodate the overall height of the user. Further, it permits a large number of exercises to be performed with the apparatus of the invention which would not be permitted without adjustable positioning of the handle. For example, some exercisers start with the handle positioned close to the floor and others start with the handle spaced at some distance from the floor.

By reference to FIGS. 1 and 3, it can be observed that the lever arm does not necessarily assume a perpendicular relationship with respect to a vertically disposed wall when in the lowermost position. In fact, it is desirable to have the lever arm assume at least an acute angle with respect to a true horizontal when in the lowermost position. In this way, the user of the apparatus can lie in the prone position and engage the handles and thereby attempt to lift the lever arm against the selected amount of weights disposed thereon.

For the purposes of the invention, it has been found that the lever arm should assume about a 15° angle with respect to a horizontal as aforesaid, although it could exceed this amount but should not assume any more than about a 25°–30° angle with respect to a true horizontal. This aarrangement is desirable to enable the handles of the lever arm to be at least 20 inches spaced above the floor or other supporting surface. Moreover, with this distance it is presumed that the lever arm is pivotally secured to the wall or other vertically exposed wall at approximately a three foot height.

In view of the fact that the lever arm can assume an angular position with respect to a true horizontal, the leg mechanism 26 is located in an angular position with respect to the lever arm section 24 and is not truely perpendicular thereto. This arrangement is provided to enable the cross-bar 33 to engage the floor or other horizontal surface in a relatively flat condition when the lever arm 20 is shifted to its lowermost position.

It can be observed that the components of the present invention can be easily fabricated from existing tubular shapes so that the overall exercising apparatus can be constructed at a relatively low unit cost. Moreover, each of the components are designed so that they are easily assembled by means of pivot pins, bolts, or the like. In addition, and by virtue of this construction, it is possible to easily adapt the body exercising apparatus to a wide variety of users. For example, by positioning the various components in proper locations, the apparatus can be used by relatively small or relatively large individuals. Moreover, and by virtue of the construction, it can be arranged in a variety of configurations to permit a wide variety of exercising positions.

Each of the components of the apparatus are preferably formed of a structural metal, such as structural steel. However, it should be understood that the components of the invention could be formed of other materials as for example, plastics and preferably reinforced plastics such as fiberglass-epoxy resins and the like.

As also illustrated in FIG. 4, the body exercising apparatus of the present invention may also be pivotally secured to a generally stationary structure 70 which is not necessarily secured to a vertically disposed wall and which still operates in accordance with and embodies the present invention.

The stationary structure as illustrated in FIG. 4 is either disposed upon or otherwise secured to a horizontal surface such as a floor. In this case, the structure which pivotally retains lever arm 20 can adopt essentially any size or shape. This latter embodiment of the invention could effectively be used in commercial establishments where a plurality of individual body exercising apparatus are connected to this structure. For example, the structure is illustrated as being rectangular in horizontal cross-section and hence at least four individual body exercising apparatus A of the present invention could be pivotally secured thereto.

While the arrangement illustrated in FIG. 4 is effective in accordance with the present invention, the body exercising apparatus is uniquely designed so that it can be secured to a generally vertically disposed wall.

Thus there has been illustrated and described a unique and novel body exercising apparatus which provides for the lifting of removable weights on a pivotally mountable lever arm and which therefore fulfills all of the objects and advantages sought therefore. It should be understood that many changes, modifications, variations and other uses in applications will become apparent to those skilled in the art after considering this specification and the accompanying drawings. Therefore, any and all such changes, modifications, variations and other uses in applications which become apparent to those skilled in the art after considering this specification and the accompanying drawings are deemed to be covered by the invention which is limited only by the following claims.

Having thus described my invention, what I desire to claim and secure by Letters Patent is:

1. A wall mountable body exercising apparatus comprising:

(a) a lever arm having first and second opposite ends;

(b) mounting means on a first end of said lever arm for pivotally mounting only said lever arm of said apparatus to a permanent relatively vertically positioned wall, said mounting means being the only portion of said apparatus mounted to any permanent structure such that the apparatus is pivotally mounted through only one pivot point, (c) weight retaining means on said lever arm for removably retaining bar-bell type weights;

(d) a leg member depending from said lever arm and being engagable with a permanent relatively horizontally positioned floor to control the lowermost limit of movement of said lever arm;

(e) adjustable positioning means at the second end of said lever arm, and (f) handle means secured to said adjustable positioning means at the second end of said lever arm for engagement by the hands of a user of said body exercising apparatus so that a user may attempt to lift the second end of the lever arm about the pivot point at the mounting means against one or more bar-bell type weights placed on said weight retaining means, said adjustable positioning means permitting the height of said handle means to be adjustably positioned relative to said lever arm.

2. The body exercising apparatus of claim 1 further characterized in that said adjustable positioning means comprises a generally tubular member secured to said second end of said lever arm and a pole located within said tubular member, and said handle means being secured to said pole.

3. The body exercising apparatus of claim 2 further characterized in that said tubular member and said pole each have a plurality of vertically spaced apart holes which are alignable so that a pin element may be inserted in aligned holes in said pole and tubular member to lock said pole in a selected position with respect to said tubular member.

4. The body exercising apparatus of claim 3 further characterized in that, said adjustable positioning means being manually adjustable.

5. The body exercising apparatus of claim 1 further characterized in that said weight retaining means comprises an elongate rod which is generally horizontally disposed for retaining bar-bell type weights.

6. A wall mountable body exercising apparatus comprising:

(a) a lever arm having first and second opposite ends, said lever arm comprising a pair of sections with one telescoped within the other to thereby adjust the overall length of the lever arm.

(b) mounting means on a first end of said lever arm for pivotally mounting said lever arm of said apparatus to a permanent relatively vertically positioned wall, said mounting means being the only portion of said apparatus mounted to any permanent structure such that the apparatus is pivotally mounted through only one pivot point, said mounting means comprising:

(1) a bracket having at least one flat plate for engagement against a wall, and (2) an outwardly struck element for pivotally retaining said first end of lever arm.

(c) weight retaining means on said lever arm for removably retaining bar-bell type weights, (d) a leg member depending from said lever arm and being engagable with a permanent relatively horizontally positioned floor to control the lowermost limit of movement of said lever arm, (e) handle means at the second end of said lever arm for engagement by the hands of a user of said body exercising apparatus so that a user may attempt to lift the second end of the lever arm about the pivot point at the mounting means against one or more bar-bell type weights placed on said weight retaining means.

7. A wall mountable body exercising apparatus comprising:

(a) a lever arm having first and second opposite ends, (b) mounting means on a first end of said lever arm for pivotally mounting only said lever arm of said apparatus to a permanent relatively vertically positioned wall, said mounting means comprising:

(1) a bracket having at least one flat plate on said bracket for engagement against a wall.

(2) an outwardly struck element on said flat plate for pivotally retaining said first end of said lever arm, (c) weight retaining means on said lever arm for removably retaining bar-bell type weights, (d) a leg member depending from said lever arm and being engagable with a floor to control the lowermost limit of movement of said lever arm, and (e) adjustable positioning means located at the second end of said lever arm, said adjustable positioning means comprising:

(1) a tubular member secured to said second end of said lever arm, (2) a pole located within said tubular member, (3) said tubular member and said pole each having a plurality of vertically spaced apart holes which are alignable so that a pin element may be inserted in aligned holes in said pole and tubular member to lock said pole in a selected position with respect to said tubular member, and (f) handle means secured to said pole at the second end of said lever arm for engagement by the hands of a user of said body exercising apparatus, so that a user may attempt to lift the lever arm pivotally with respect to the mounting means against the weight placed on said weight retaining means, said adjustable positioning means being manually actuable so that the height of said handle means is adjustably positionable relative to said lever arm.

8. A body exercising apparatus comprising:

(a) a lever arm having first and second opposite ends, (b) a mounting means on the first end of said lever for pivotal mounting to a relatively stationary structure, (c) weight retaining means on said lever arm for removably retaining bar-bell type weights, (d) a leg member depending from said lever arm and being engagable with a floor to control the lowermost limit of movement of said lever arm, (e) adjustable positioning means located at the second end of said lever arm to enable an adjustable positioning relative to said lever arm, said adjustable positioning means comprised of:

(1) a generally tubular member secured to said second end of said lever arm, and (2) a pole located within said tubular member, (f) handle means secured to said pole of said adjustable positioning means for engagement by the hands of a user of said body exercising apparatus, so that a user may attempt to lift the lever arm pivotally with respect to the mounting means against the weight placed on said weight retaining means, said adjustable positioning means being manually adjustable so that the height of said handle means is adjustably positionable relative to said lever arm.

9. The body exercising apparatus of claim 8 further characterized in that said tubular member and said pole each have a plurality of vertically spaced apart holes which are alignable so that a pin element may be inserted in aligned holes in said pole and tubular member to lock said pole in a selected position with respect to said tubular member.

10. A wall mountable body exercising apparatus comprising:

(a) a lever arm comprised of a first tubular lever arm section and a second lever arm section telescopically fitted within said first lever arm section, said first lever arm section having a first end and said second lever arm section having a second opposite end, (b) pin means extending between said first and second lever arm sections to lock them together, (c) mounting means on a first end of said lever arm for pivotally mounting only said lever arm of said apparatus to a permanent relatively vertically positioned wall, said mounting means comprising:

(1) a bracket having at least one flat plate on said bracket for engagement against a vertically positioned wall, (2) an outwardly struck clevised element on said flat plate for pivotally retaining said first end of said lever arm, (d) a transversely extending retaining rod rigidly mounted on said lever arm for removably retaining bar-bell type weights, said rod having a cross-sectional size and shape to accommodate apertures in conventional bar-bell type weights, (e) a leg member depending from said lever arm and being engagable with a floor to control the lowermost limit of movement of said lever arm, and (f) adjustable positioning means located at the second end of said lever arm, said adjustable positioning means comprising:

(1) a tubular member having a central bore secured to said second end of said lever arm, (2) a pole located within said tubular member and having an overall size and shape to slidably fit within the bore of said tubular member, (3) said tubular member and said pole each having a plurality of vertically spaced apart holes which are alignable so that a pin element may be inserted in aligned holes in said pole and tubular member to lock said pole in a selected position with respect to said tubular member, and (g) a handle secured to said pole at the second end of said lever arm for engagement by the hands of a user of said body exercising apparatus, so that a user may attempt to lift the lever arm pivotally with respect to the mounting means against the weight placed on said weight retaining means, said handle having a pair of spaced apart outwardly extending sections with handle portions thereon, said adjustable positioning means being manually actuable so that the height of said handle means is adjustably positionable relative to said lever arm.

11. A wall mountable body exercising apparatus comprising:

(a) a lever arm having first and second opposite ends, (b) mounting means on a first end of said lever arm for pivotally mounting said lever arm of said apparatus to a permanent relatively vertically positioned wall, said mounting means being the only portion of said apparatus mounted to any permanent structure such that the apparatus is pivotally mounted through only one pivot point, (c) weight retaining means coupled to said lever arm for retaining weight against which the user will lift a portion of the lever arm, (d) a leg member depending from said lever arm, (e) an end on said leg member and being engagable with a permanent relatively horizontally positioned floor to control the lowermost limit of movement of said lever arm, (f) adjustable positioning means at the second end of said lever arm to enable an adjustable positioning, and (g) handle means secured to said adjustable positioning means at the second end of said lever arm for engagement by the hands of a user of said body exercising apparatus so that a user may attempt to lift the second end of the lever arm about the pivot point at the mounted means against the weight on said weight retaining means, said adjustable positioning means permitting the height of said handle means to be adjustably positioned relative to said lever arm.

12. The body exercising apparatus of claim 11 further characterized in that said mounting means comprises a bracket having at least one flat plate for engagement against a wall and an outwardly struck element for pivotally retaining said first end of said lever arm.

13. The body exercising apparatus of claim 11 further characterized in that said lever arm has one arm section telescoped within another to be adjustable.

14. The body exercising apparatus of claim 11 further characterized in that said leg member is angularly positioned relative to said lever arm other than at a 90° angle.

* * * * *